US006895719B1

(12) United States Patent
Herbert

(10) Patent No.: US 6,895,719 B1
(45) Date of Patent: May 24, 2005

(54) FLOOR-MOUNTED DISPOSABLE SYSTEM WITH MOVEABLE DUST LOOSENING RIB INSERT

(75) Inventor: Mark S. Herbert, 5418 N. Cigrand, Waubeka, WI (US) 53021

(73) Assignee: Mark S. Herbert, Sheboygan, WI (US)

( * ) Notice: Subject to any disclaimer, the term of this patent is extended or adjusted under 35 U.S.C. 154(b) by 34 days.

(21) Appl. No.: 10/226,323

(22) Filed: Aug. 22, 2002

(51) Int. Cl.[7] ..... E04F 17/04
(52) U.S. Cl. ..... 52/302.1; 52/473; 454/274; 454/278; 454/290
(58) Field of Search ..... 52/302.1, 302.3, 52/203, 473; 454/290, 325

(56) References Cited

U.S. PATENT DOCUMENTS 5,458,408 A * 10/1995 Cooper et al. ..... 312/213
5,758,462 A * 6/1998 Finn ..... 52/302.1
5,974,749 A * 11/1999 Herbert ..... 52/302.1
6,012,260 A * 1/2000 Hendrick et al. ..... 52/302.1
6,322,442 B1 * 11/2001 Cordell ..... 454/290

* cited by examiner

*Primary Examiner*—Carl D. Friedman
*Assistant Examiner*—Yvonne M. Horton
(74) *Attorney, Agent, or Firm*—Andrus, Sceales, Starke & Sawall, LLP

(57) ABSTRACT

A dust and debris disposal system has a floor-mounted housing adapted to be mounted over an opening formed in a floor for receiving debris particles swept thereto, and a set of dust loosening ribs fixed to an projecting forwardly from a posterior portion of the housing. The invention is improved wherein the dust loosening ribs are moveably mounted on the housing. In one embodiment, the dust loosening ribs and a decorative cover are pivotally attached to the housing by means of a hinge. In another embodiment a rib insert is supported by as ledge structure on the housing and may be snap fit relative to the housing.

11 Claims, 3 Drawing Sheets

FLOOR-MOUNTED DISPOSABLE SYSTEM WITH MOVEABLE DUST LOOSENING RIB INSERT

FIELD OF THE INVENTION

The present invention relates generally to floor-mounted, dust and debris disposal systems used in conjunction with a dust and debris gathering device such as a broom or mop. More particularly, the invention pertains to improvements in the internal structure of the disposal system which is engageable with the broom or mop.

BACKGROUND OF THE INVENTION

Applicant is the inventor of U.S. Pat. No. 5,974,749 issued Nov. 2, 1999 which is hereby incorporated by reference. In this patent, there is disclosed a dust and debris disposal system adapted to be mounted over an opening formed in a floor. A housing is anchored to a flat upper surface of the floor around the opening and includes a raised support shell having a plurality of dust loosening ribs extending forwardly and perpendicularly and fixed from a rear portion of the shell. With this construction, dust and debris gathered from the floor with the use of a broom or mop is swept to the front of the housing, and deposited into a dust and debris orifice formed between the front of the housing and the forward tips of the dust loosening ribs. Dust and debris entering the orifice will fall by gravity, typically to a receptacle, beneath the floor. Dust and debris attached to the broom or mop is dislodged therefrom for release into the orifice by engaging the broom or mop against the dust loosening ribs.

Applicant has discovered that the fixed nature of the dust loosening ribs creates some limitations in or drawbacks to the dust and debris disposal system. For example, it is desirable to make the dust loosening ribs movably mounted relative to the housing so as to allow for better maintenance and cleaning of the dust and debris disposal system. Further, it is desirable to make the dust loosening ribs movable so that in the event a person, particularly a child, lodges his/her fingers/hand in the orifice between the tips of the dust loosening ribs and the floor or front of the housing, the ribs will move upwardly to free the jammed fingers/hand without injury thereto.

SUMMARY OF THE INVENTION

It is a general object of the present invention to provide an improved floor-mounted dust and debris disposal system which results in a more sanitary and safer work site.

It is another object of the present invention to provide a dust and debris disposal system having a set of dust loosening ribs swingably or removably mounted to a floor-mounted housing.

It is a further object of the present invention to provide a dust and debris disposal system having a movable dust loosening rib insert with a decorative cover.

It is also an object of the present invention to provide a dust and debris disposal system having a housing formed with various mounting structure for allowing a movability of the dust loosening ribs.

It is yet another object of the present invention to provide a dust and debris disposal system which allows for repositioning of the dust loosening ribs so as to vary the size of the dust and debris orifice.

In one aspect of the invention a dust and debris disposal system has a floor-mounted housing adapted to be mounted over an opening formed in a floor for receiving debris particles swept thereto, and a set of dust loosening ribs fixed to and projecting forwardly from a posterior portion of the housing. The invention is improved wherein the dust loosening ribs are moveably mounted on the housing.

In a preferred embodiment, the dust loosening ribs are pivotably attached to the housing. The housing includes a pair of lateral portions connected to the posterior portion. The dust loosening ribs are attached to a front surface of a dust loosening rib block. The dust loosening rib block has a cover attached thereto which rests on a top surface of the housing, and is pivotally attached to the posterior portion of the housing. The dust loosening ribs are variably spaced from a floor front wall partially defining the opening so as to enable variably sized debris particles swept to the housing to fall through the opening. In another embodiment, the lateral portions and the posterior portion are provided with ledges for supporting the dust loosening ribs. The dust loosening ribs are snap fit on lateral walls of the housing.

In another aspect of the invention, a dust and debris disposal system is adapted to be mounted around an opening formed in a support surface, such as a floor, and used in conjunction with a dust and debris gathering device such as a broom or mop. The disposal system includes a housing having a support shell attached to the floor and formed from a posterior portion connected to a pair of lateral portions, the support surface being open along a front area so that debris particles swept to the housing fall through the opening in the floor. A cover is hingedly attached to the posterior portion of the housing. A dust loosening rib block is attached to a bottom surface of the cover. A dust loosening rib insert having a series of dust loosening ribs is secured to a front edge of the block. At least one chain extends between one of the lateral portions and the bottom surface of the cover.

In yet another aspect of the invention, a dust and debris disposal system is adapted to be mounted in an opening formed in a support surface such as a floor, and used in conjunction with a dust and debris gathering device such as a broom or mop. The disposal system includes a housing having a support shell attached to the floor and formed with a posterior portion, a pair of lateral portions, and a ramped front wall. All the portions extend downwardly along the surfaces forming the opening in the floor. The lateral portions and the posterior portion are provided with support ledges. A dust loosening rib insert includes a series of parallel, spaced apart, dust loosening ribs alternating in length, each rib having a curved buttress attached thereto. The rib insert is movably supported by means of the buttresses engaging the support ledges on the lateral and posterior portions. The dust loosening rib insert may be snap fit on the housing.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
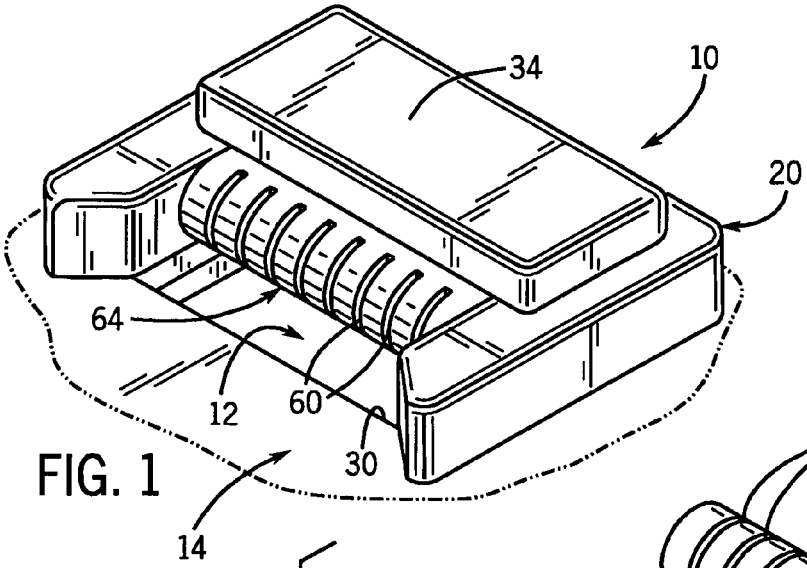
FIG. 1 is a front perspective view of a dust and debris disposal system constructed in accordance with the invention.
Figure 2:
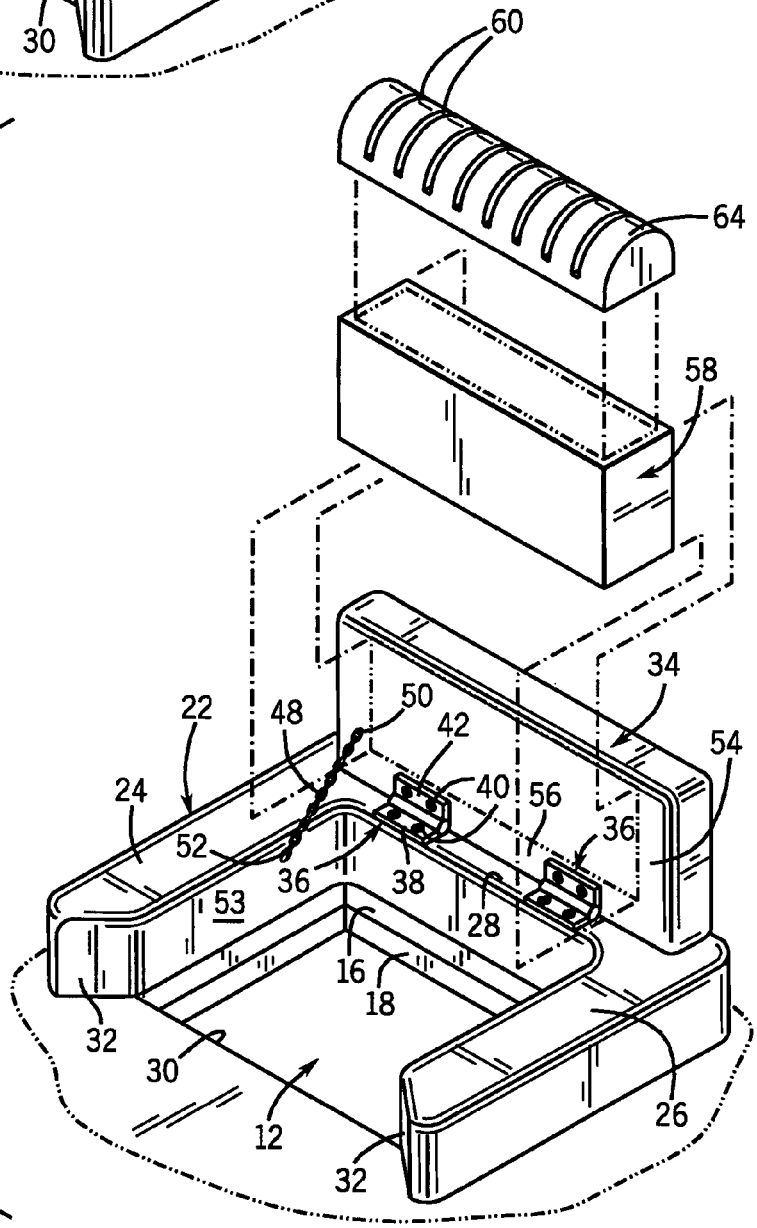
FIG. 2 is an exploded view of the system shown in FIG. 1.
Figure 3:
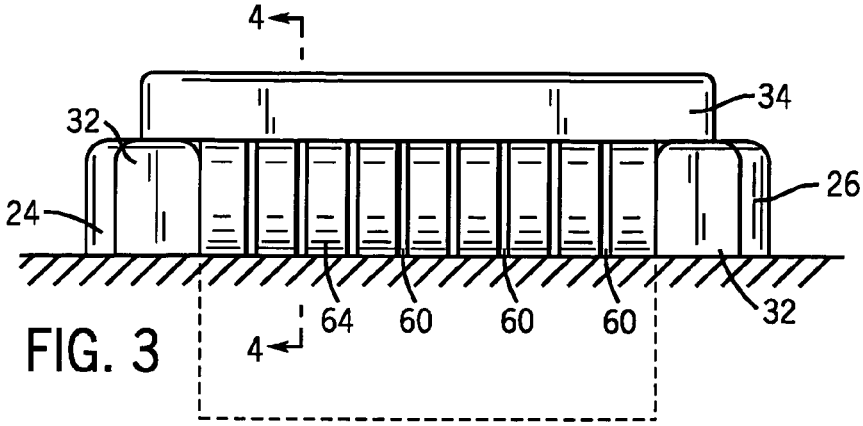
FIG. 3 is a front elevational view of the system shown in FIG. 1.
Figure 4:
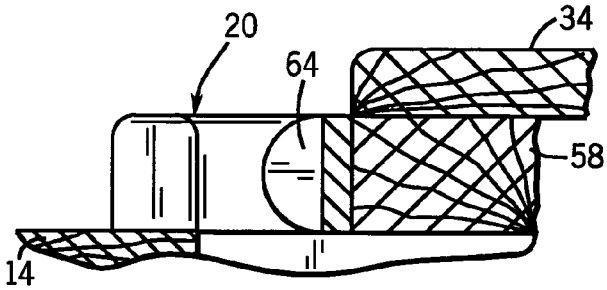
FIG. 4 is a partial sectional view taken on line 4—4 of FIG. 3.
Figure 5:
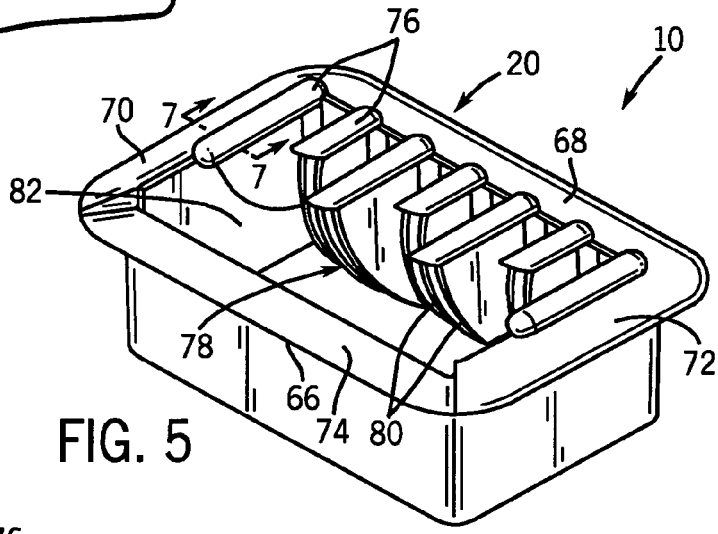
FIG. 5 is a first alternative embodiment of the system shown in FIG. 1.

The present invention provides a floor-mounted, disposal system which improves the system described in the current inventor's U.S. Pat. No. 5,974,749.

Referring now to FIGS. 1 through 4, there shown is a duct and debris disposal system 10 mounted over an opening 12 in a floor 14 for receiving debris particles swept thereto by a mop or broom. The floor 14 is represented as a two-layer wooden combination having a main floor 16 and a sub floor 18, although the structure is not limiting to the invention. The disposal system 10 is typically comprised of a generally U-shaped housing 20 having a support shell 22 attached to the floor 14 around the opening 12. The support shell 22 includes a pair of parallel, spaced apart lateral portions 24, 26 orthoganally interconnected by a posterior portion 28. The support shell 22 is open along a front area thereof so that debris particles swept to the housing 20 fall over a front wall 30 of the opening 12 in the floor 14 typically to a receptacle (not shown) beneath the floor 14. Frontal areas 32 of the lateral portions 24, 26 may be angled so as to guide debris particles to the opening 12 more expeditiously.

A generally rectangular, decorative cover 34 is swingably mounted to the posterior portion 28 by a pair of conventional hinge 36, mechanisms each having one leaf 38 which is attached by fasteners 40 to the top surface of the posterior portion 28, and another leaf 42 which is joined by fasteners 40 to an underside of the cover 34. A chain 48 has one end 50 which is anchored to one side of the underside of the cover 34, and an opposite end 52 secured to an internal wall 53 of the lateral portion 24. The cover 34 has lateral and posterior segments 54, 56 which overlap the top surfaces of the lateral and posterior portions 24, 26, 28, respectively, so that the cover 34 may assume a closed, overlapping and generally horizontal position shown in FIG. 1. The cover 34 is moveable to an open, generally vertical position shown in FIG. 2 as restricted by the chain 48.

A dust loosening rib block or insert 58 is fixed, such as by adhesive, to the underside of the cover 34. The rib block 58 has a length which is shorter than the distance between the internal walls 53 or the lateral portions 24, 26 so that it may fit therebetween when the cover 34 is closed upon the housing 20. A set of dust loosening ribs 60 are, in turn, connected as such as by adhesive to a front surface of the rib block 58. The dust loosening ribs 60 are formed as spaced grooves in a semi-circular block 64 and function to separate any dust and debris from a mop or broom moved laterally there along. The semi-circular block 64 has a length generally equal to the length of the rib block 58 so that when the cover 34 is closed (FIG. 1), the dust loosening ribs 60 fit between the internal walls 53 of the lateral portions 24, 26, and lies spaced from the front wall 30 of the floor opening 12. Together, the front tips of the dust loosening ribs 60 and the front wall 30 of the floor opening 12 define a dust and debris orifice into which dust and debris particles are swept. By changing the size of the rib block 58 or the dust loosening ribs 60, the size of the orifice can be altered to accommodate different sized of debris particles.

In the preferred embodiment, the housing 20, cover 34, rib block 58 and dust loosening rib 60 are all fabricated from wood, but it should be understood that the components of the dust and debris disposal system 10 could well be fabricated of plastic, metal, or any other material.

In use, dust and debris are retrieved from the work site and swept by broom or mop into the orifice and the receptacle beneath the floor 14. Further dislodging of dust and debris is achieved by maneuvering the broom or mop along the dust loosening ribs 60.

With the structure set forth above, the integral cover 34, rib block 58 and dust loosening ribs 60 can be swung upwards to allow inspection, cleaning and other maintenance of the internal walls 53 and the top portions of the lateral and posterior portions 24, 26, 28, respectively, of the housing 20. In addition, should a person, especially a child, place his/her finger/hand in the orifice between the tips of the dust loosening ribs 60 and the front wall 30 of the floor 14, the ribs 60 will move upwardly to quickly free the jammed finger/hand without injury thereto.

FIGS. 5 through 8 illustrate an alternative embodiment of the present invention which is preferably constructed of plastic. In this version, the housing has a front portion 66, a posterior portion 68 and a pair of lateral portions 70, 72 joined together. Each of the portions 66–72 depend downwardly into the floor opening to form a neck which guides dust and debris downwardly. The front portion 66 includes a ramp area 74 over which duct and debris particles are swept into the opening 12. A set of spaced apart dust loosening ribs 76 is provided on an insert. Each of the ribs 76 alternates in length and is supported by a curved buttress 78 formed from a pair of parallel surfaces 80 having a quarter circle shape.

Figure 7:
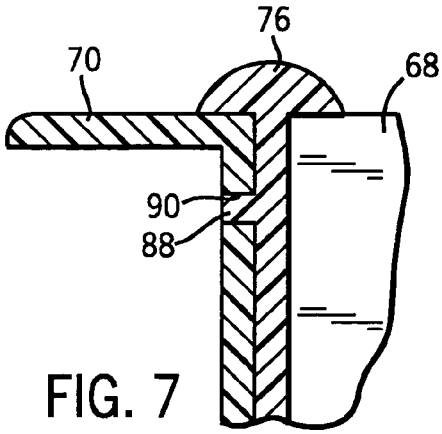
FIG. 7 is a partial sectional view taken on line 7—7 of FIG. 5.
Figure 6:
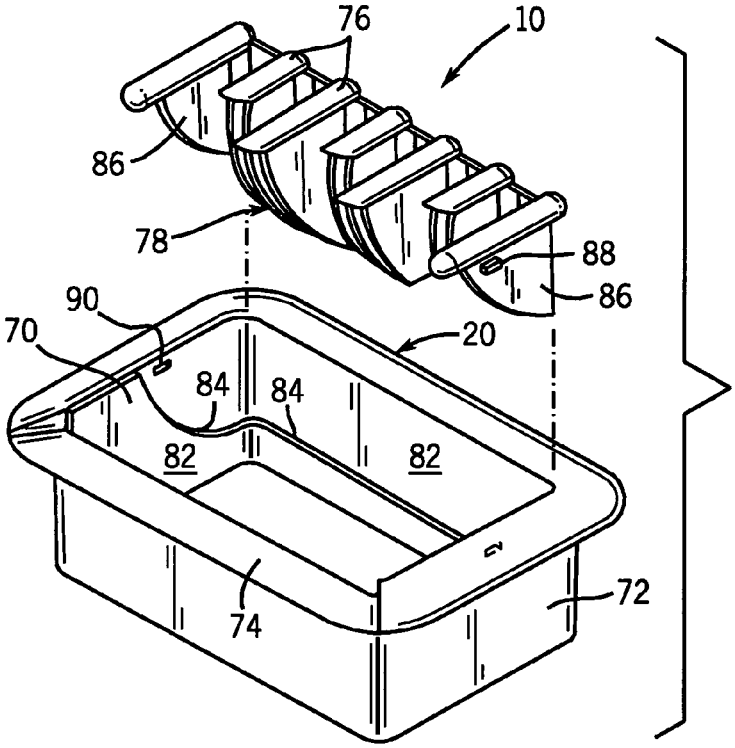
FIG. 6 is an exploded view of the system of FIG. 5.
Figure 8:
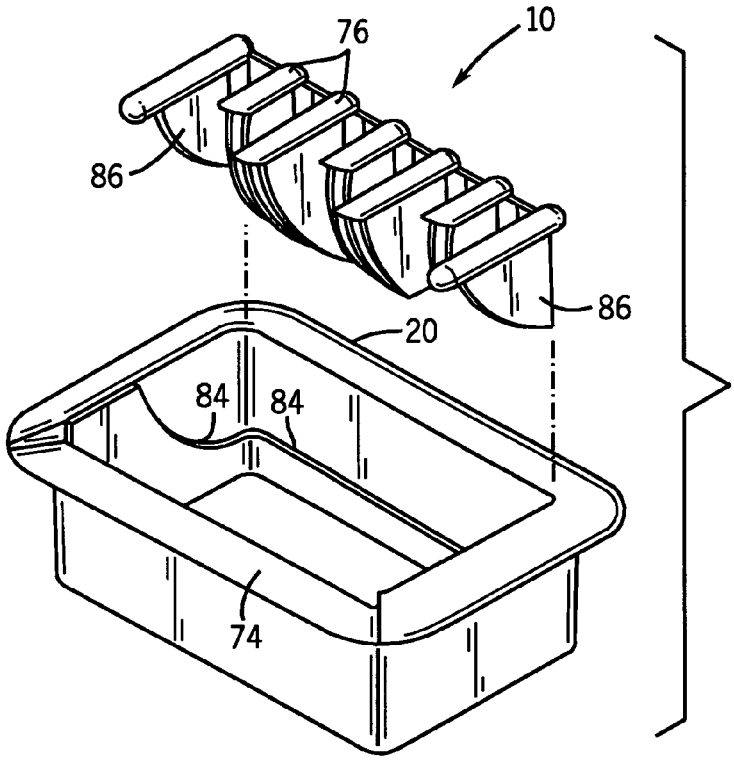
FIG. 8 is an exploded view of a second alternative embodiment of the system.

As seen in FIG. 6, the internal walls 82 of the lateral and posterior portions 68, 70, 72, respectively, are formed with support ledges 84 which are engageable with the outermost rib buttresses 86 and each rear portion of the rear buttresses 78. In addition, each outermost buttress 86 is provided with a nib 88 which snap fits into an opening 90 formed in the internal walls 82 of the lateral portion 70, 72 (FIGS. 6 and 7). If desired, the snap fit feature can be eliminated to form a free floating rib insert 76 shown in FIG. 8 as a second embodiment, wherein the rib insert 76 is simply supported by means of engagement between the buttresses 78 and ledges 84.

In either design, the rib insert 76 is moveable away from the housing 20 for maintenance or to prevent injury from a jammed hand/finger. The snap fit design is intended to enable the rib insert 76 to separate from the housing 20 with a small amount of force. A non-snap fit or free floating design allows the rib insert 76 to more easily be elevated away from the housing 20.

It should be understood that the invention contemplates other structures wherein a set of dust loosening ribs 60 or 76 is moveably supported on a housing 28. For example, the rib insert 76 of FIGS. 5 through 8 could be attached by a living hinge or other hinge design to the top surface of the posterior portion 68. Additionally, other ledges or support structures may be formed on the housing 20 to cooperate with structure provided on the rib insert 60 or 76.

Various alternatives and embodiments are contemplated as being within the scope of the following claims particularly pointing out and distinctly claiming the subject matter regarded as the invention.

I claim:

1. In a dust and debris disposal system having a floor-mounted housing adapted to be mounted over an opening formed in the floor for receiving debris particles swept thereto, and a set of dust loosening ribs projecting forwardly from a posterior portion of the housing, the improvement wherein:

the dust loosening ribs are pivotally attached to the housing enabling the ribs to swing upwardly away from and completely out of the housing to allow for inspection, cleaning, and maintenance of the housing.

2. The improvement of claim 1, wherein the housing includes a pair of lateral portions connected to the posterior portion.

3. The improvement of claim 1, wherein the dust loosening ribs are attached to a dust loosening rib block.

4. The improvement of claim 3, wherein the dust loosening rib block has a cover attached thereto which rests on a top surface of the housing, and is pivotally secured by a hinge to the posterior portion.

5. The improvement of claim 1, wherein the dust loosening ribs are variably spaced from a floor front wall partially defining the opening so as to enable variably sized debris particles swept to the housing to fall through the opening.

6. The improvement of claim 1, wherein the lateral portions and the posterior portion are provided with ledges for supporting the dust loosening ribs.

7. The improvement of claim 1, wherein the dust loosening ribs are snap fit on lateral portions of the housing.

8. A dust and debris disposal system adapted to be mounted around an opening formed in a support surface, such as a floor, and used in conjunction with a dust and debris gathering device such as a broom or mop, the disposal system comprising:

a housing having a support shell attached to the floor and formed from a posterior portion connected to a pair of lateral portions, the support shell being open along a front area so that debris particles swept to the housing fall through the opening in the floor;

a cover hingedly attached to the posterior portion of the housing;

a dust loosening rib block attached to a bottom surface of the cover; and a dust loosening rib insert having a series of dust loosening ribs secured to a front edge of the block.

9. The disposal system of claim 8, including at least one chain extending between one of the lateral portions and the bottom surface of the cover.

10. A dust and debris disposal system adapted to be mounted in an opening formed in a support surface, such as the floor, and used in conjunction with a dust and debris gathering device such as a broom or mop, the disposal system comprising:

a housing having a support shell attached to the floor and formed with a posterior portion, a pair of lateral portions, and a ramped front wall, all the portions extending downwardly along the surfaces forming the opening in the floor, the lateral portions and the posterior portion being provided with support ledges; and a dust loosening rib insert including a series of parallel, spaced apart dust loosening ribs alternating in length, each rib having a curved buttress attached thereto, the rib insert being moveably supported by means of the buttresses engaging the support ledges on the lateral and posterior portions.

11. The disposal system of claim 10, wherein the dust loosening rib insert is snap fit on the housing.

* * * * *